US010193261B2

(12) United States Patent
Pittenger

(10) Patent No.: US 10,193,261 B2
(45) Date of Patent: Jan. 29, 2019

(54) GENDERLESS ELECTRIC TERMINALS FOR VEHICLES

(71) Applicant: Ford Global Technologies, LLC, Dearborn, MI (US)

(72) Inventor: Joel Allen Pittenger, Rochester Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/469,066

(22) Filed: Mar. 24, 2017

(65) Prior Publication Data

US 2018/0277976 A1 Sep. 27, 2018

(51) Int. Cl.
*H01R 13/28* (2006.01)
*H01R 13/05* (2006.01)

(52) U.S. Cl.
CPC ..... *H01R 13/28* (2013.01); *H01R 13/05* (2013.01); *H01R 2201/26* (2013.01)

(58) Field of Classification Search
CPC ..... H01R 12/718; H01R 13/28
USPC ..... 439/290, 291, 295
See application file for complete search history.

(56) References Cited

U.S. PATENT DOCUMENTS 2,762,022 A 8/1954 Benander et al.
3,480,903 A 11/1969 Filson
3,794,957 A 2/1974 Winkler
3,846,735 A 11/1974 Carter et al.
4,963,102 A 10/1990 Gettig
4,990,099 A 2/1991 Marin et al.
5,035,639 A * 7/1991 Kilpatrick ..... H01R 13/28 439/290
5,266,046 A 11/1993 Bogiel
5,577,928 A 11/1996 Duclos
5,941,722 A * 8/1999 Chen ..... H01R 13/28 439/291
6,065,987 A 5/2000 Bigotto
6,942,492 B2 9/2005 Alvarez
7,033,194 B1 4/2006 Le Beau
7,976,326 B2 * 7/2011 Stoner ..... H01R 13/193 439/295

(Continued)

FOREIGN PATENT DOCUMENTS

DE 1177231 B 9/1964
FR 2319216 A1 2/1977

(Continued)

OTHER PUBLICATIONS

Solderless Terminals, Terminal Blocks and Connectors, www.molex.com.

(Continued)

*Primary Examiner* — Phuong Dinh
(74) *Attorney, Agent, or Firm* — James P. Muraff; Neal, Gerber & Eisenberg LLP

(57) ABSTRACT

Method and apparatus are disclosed for genderless electric terminals of vehicles. An example genderless electric terminal includes a first arm, a second arm opposite the first arm, and a wall integrally connecting the first arm and the second arm to define a slot. The example genderless electric terminal also includes a first flexible contact extending from an end of the first arm and protruding into the slot to engage a first arm of a different genderless electric terminal that is inserted into the slot.

19 Claims, 7 Drawing Sheets

(56) References Cited

U.S. PATENT DOCUMENTS 9,413,094 B2 * 8/2016 Qi ..... H01R 13/113

FOREIGN PATENT DOCUMENTS

| | | | |
|---|---|---|---|
| GB | 558603 | A | 1/1944 |
| GB | 960997 | A | 6/1964 |
| GB | 1108074 | A | 4/1968 |

OTHER PUBLICATIONS

Search Report dated Sep. 12, 2018 for GB Patent Application No. 1804457.8 (4 Pages).

* cited by examiner

GENDERLESS ELECTRIC TERMINALS FOR VEHICLES

TECHNICAL FIELD

The present disclosure generally relates to electric terminals and, more specifically, to genderless vehicle electrical terminals.

BACKGROUND

Vehicles generally include electric connectors for electrically connecting electronic components (e.g., sensors, displays, speakers, electronic control units, etc.) together. Typically, an electric connector includes one or more terminals that couple to respective one or more terminals of another electric connector to connect the electric connectors together. Oftentimes, one of the electric connectors includes protrusions (e.g., male components) and the other of the electric connectors includes indentations (e.g., female components) that receive the protrusions to couple the electric connectors together.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown for genderless electric terminals for vehicles. An example disclosed genderless electric terminal includes a first arm, a second arm opposite the first arm, and a wall integrally connecting the first arm and the second arm to define a slot. The example disclosed genderless electric terminal also includes a first flexible contact extending from an end of the first arm and protruding into the slot to engage a first arm of a different genderless electric terminal that is inserted into the slot.

An example disclosed vehicle includes an electronic control unit, a first connector electrically connected to the electronic control unit, and a second connector to connect to the first connector. The first connector and the second connector include genderless electric terminals that each include opposing arms, a wall integrally connecting the opposing arms to define a slot, and flexible contacts extending from ends of the opposing arms and protruding into the slot.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
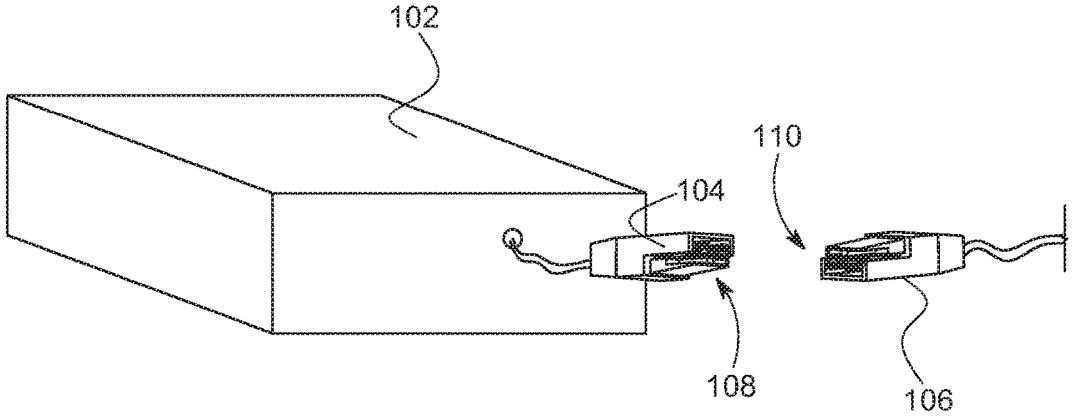
FIG. 1 illustrates an example electric connector including genderless electric terminals in accordance with the teachings herein.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Vehicles generally include electric connectors for electrically connecting electronic components (e.g., sensors, displays, speakers, electronic control units, etc.) together. Typically, an electric connector includes one or more terminals that couple to respective one or more terminals of another electric connector to connect the electric connectors together. Oftentimes, one of the electric connectors includes protrusions (e.g., male components) and the other of the electric connectors includes indentations (e.g., female components) that receive the protrusions to couple the electric connectors together. In instances in which a male connector and a female connector are used to connect electrical components, a manufacturer must stock and/or obtain two distinct connector components, thereby potentially increasing manufacturing costs.

The example connectors disclosed herein include one or more example genderless electric terminals to enable connectors that are identical or substantially similar to connect to each other, thereby potentially reducing a number of different components utilized to manufacture a vehicle. The example genderless electric terminals may reduce a length of the example connectors to facilitate installation of the example connectors on the vehicle. Further, the example genderless electric terminals deter the electric terminals from being bent and/or pushed inward into the corresponding connector to facilitate secure connections between the example connectors. As used herein, a "genderless terminal" and a "genderless electric terminal" refer to a terminal that includes one or more protrusions (e.g., male components) and one or more indentations (e.g., female components) such that the terminal is able to connect to an identical or substantially similar terminal. As used herein, a "genderless connector" and a "genderless electric connector" refer to an electric connector that includes one or more genderless electric terminals.

Some example genderless electric terminals disclosed herein include opposing arms, a wall integrally connecting the opposing arms to define a slot between the opposing arms, and flexible contacts extending from ends of the opposing arms and protruding into the slot. For example, the flexible contacts of each of the genderless electric terminals include a first flexible contact extending from a first end of one of the opposing arms and a second flexible contact extending from a second end of the other of the opposing arms. In some examples, to connect a first genderless electric terminal to a second genderless electric terminal, one of the opposing arms of the first genderless electric terminal is inserted into the slot of the second genderless electric terminal and one of the opposing arms of the second genderless electric terminal simultaneously is inserted into the slot of the first genderless electric terminal. Further, the flexible contacts may extend at least half a length of the corresponding genderless electric terminal to facilitate the flexible terminals of the first genderless electric terminal to engage the flexible terminals of the second genderless electric terminal.

Other example genderless electric terminals disclosed herein include opposing convex arms that are integrally connected and each include a distal end. The opposing convex arms define a slot in which another arm of another genderless electric terminal is inserted, and the distal ends retain the other arm in the slot. For example, the opposing convex arms that are integrally formed define a horseshoe-shaped cross-section of the genderless electric terminal in which the distal ends extend toward each other. In some examples, to connect a first genderless electric terminal to a second genderless electric terminal, one of the opposing arms of the first genderless electric terminal is inserted into the slot of the second genderless electric terminal and one of the opposing arms of the second genderless electric terminal simultaneously is inserted into the slot of the first genderless electric terminal. Further, flanges may protrude from the distal ends of the opposing convex arms in an outward direction away from the slot and have a curved surface that engage another genderless electric terminal when inserted into a slot of the other genderless electric terminal.

Other example genderless electric terminals disclosed herein include an arched arm extending in a first direction and opposing arms adjacent to the arched arm that define a slot extending in the first direction adjacent to the arched arm. The arched arm is to insert into another slot of another genderless electric terminal, and the slot is to receive another arched arm of the other genderless electric terminal to connect the genderless electric terminals together. For example, to electrically connect a first genderless electric terminal and a second genderless electric terminal, the arched arm of the first genderless electric terminal engages the opposing arms of the second genderless electric terminal and the arched arm of the second genderless electric terminal engages the opposing arms of the first genderless electric terminal. The arched arm and the opposing arms are integrally connected via a base. The arched arms are arched and flexible to facilitate insertion into slots of other genderless electric terminals. Further, the arched arms are arched and flexible to facilitate engagement to other genderless electric terminals when the arched arms are inserted into slots of other genderless electric terminals.

Turning to the figures, FIG. 1 illustrates an electronic control unit (ECU) 102 of a vehicle. The ECU 102 monitors and controls one or more subsystems of the vehicle. For example, the ECU 102 is a discrete set of electronics that include its own circuit(s) (e.g., integrated circuits, microprocessors, memory, storage, etc.), firmware, sensors, actuators, and/or mounting hardware. The ECU 102 communicates and exchanges information via a vehicle data bus. Additionally, the ECU 102 many communicate properties (e.g., status of the ECU 102, sensor readings, control state, error and diagnostic codes, etc.) to and/or receive requests from other ECUs. For example, a vehicle may have seventy or more ECUs (e.g., including the ECU 102) that are positioned in various locations around the vehicle and are communicatively coupled by the vehicle data bus. For example, the ECU 102 may be a body control module, a brake control module, an engine control unit, a speed control unit, a telematic control unit, etc. Further, the vehicle may be a standard gasoline powered vehicle, a hybrid vehicle, an electric vehicle, a fuel cell vehicle, and/or any other mobility implement type of vehicle. The vehicle includes parts related to mobility, such as a powertrain with an engine, a transmission, a suspension, a driveshaft, and/or wheels, etc. The vehicle may be non-autonomous, semi-autonomous (e.g., some routine motive functions are controlled by the vehicle), or autonomous (e.g., motive functions are controlled by the vehicle without direct driver input).

In the illustrated example, the vehicle includes a connector 104 (e.g., a first connector, a first genderless connector) that is structurally and electrically connected to the electronic control unit 102. Further, the vehicle includes a connector 106 (e.g., a second connector, a second genderless connector). For example, the connector 106 may be electrically connected to another ECU, a vehicle data bus, and/or any other electronic device of the vehicle.

The connector 104 and the connector 106 of the illustrated example are configured to connect or couple together to electrically connect the electronic device to the ECU 102. As illustrated in FIG. 1, the connector 104 includes one or more genderless electric terminals 108 (e.g., a first genderless electric terminal), and the connector 106 includes one or more genderless electric terminals 110 (e.g., a second genderless electric terminal). For example, each of the genderless electric terminals 108 corresponds to a respective one of the genderless electric terminals 110. The genderless electric terminals 108 and the genderless electric terminals 110 include conductive material to enable the connector 104 and the connector 106 to electrically connect the ECU 102 to other electronic devices. To electrically connect the connector 106 and, thus, the corresponding electronic device to the ECU 102 via to the connector 104, the genderless electric terminals 110 of the connector 106 engage and couple to the corresponding the genderless electric terminals 108 of the connector 104.

Figure 2:
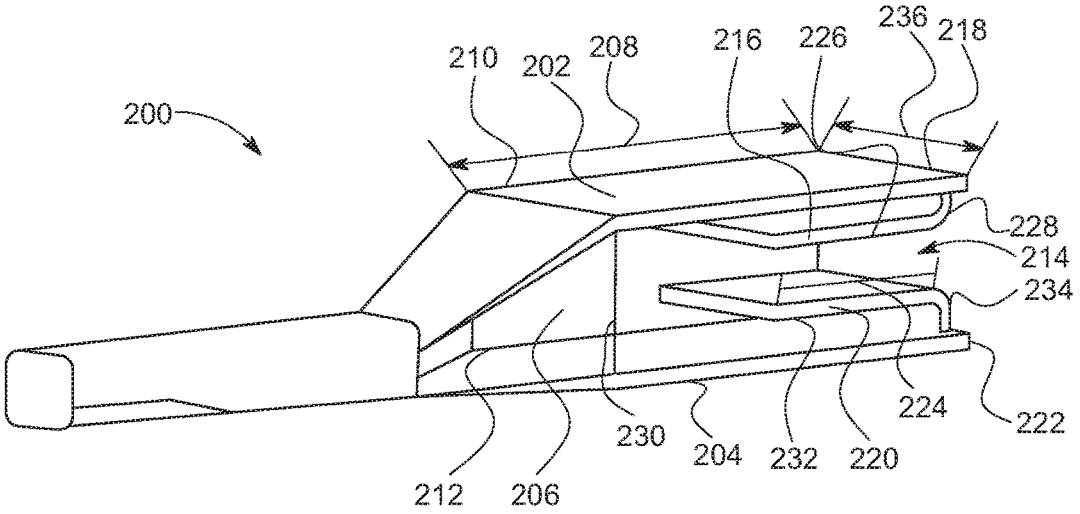
FIG. 2 illustrates an example genderless electric terminal.
Figure 3:
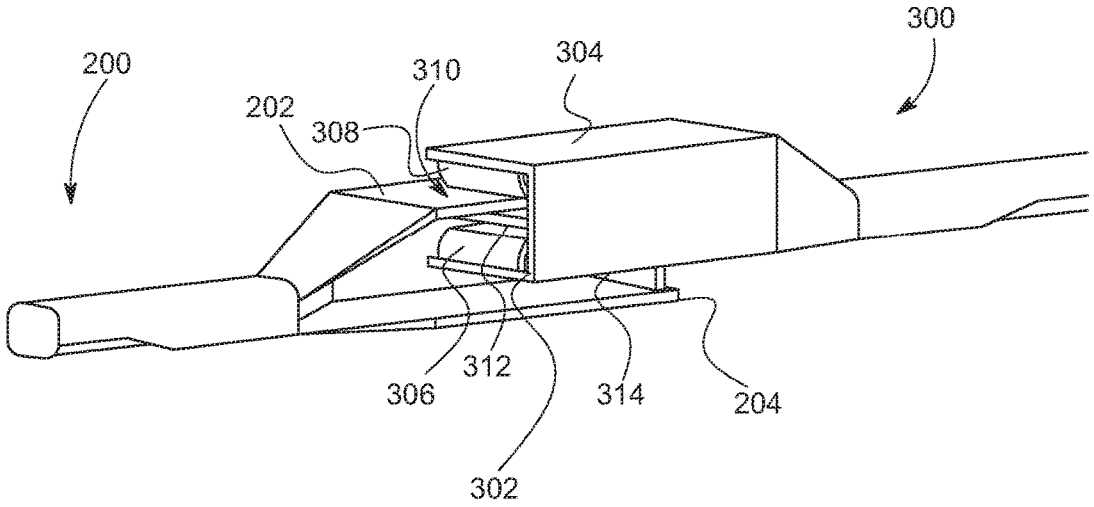
FIG. 3 illustrates the genderless electric terminal of FIG. 2 coupled to another genderless electric terminal.

FIGS. 2 and 3 illustrate an example genderless electric terminal 200 and another example genderless electric terminal 300. More specifically, FIG. 2 depicts the genderless electric terminal 200 (e.g., a first genderless terminal), and FIG. 3 depicts the genderless electric terminal 200 and the genderless electric terminal 300 (e.g., a second genderless terminal) coupled together. For example, the genderless electric terminal 200 is one of the genderless electric terminals 108 of the connector 104, and the genderless electric terminal 300 is one of the genderless electric terminals 110 of the connector 106.

As illustrated in FIG. 2, the genderless electric terminal 200 includes an arm 202 (e.g., a first arm), an arm 204 (e.g., a second arm) opposing the arm 204, and a wall 206 integrally connecting the arm 202 and the arm 204. The arm 202, the arm 204, and the wall 206 extend along a length 208 of the genderless electric terminal 200. For example, the wall 206 is integrally connected to an edge 210 (e.g., a first edge) of the arm 202 and an edge 212 (e.g., a second edge) of the arm 204. The arm 202, the arm 204, and the wall 206 define a slot 214 of the genderless electric terminal 200. In the illustrated example, the arm 202 is parallel to the arm 204 and the wall 206 is perpendicular to the arm 202 and the arm 204 such that the slot 214 has a rectangular cross-section.

As illustrated in FIG. 2, a flexible contact 216 (e.g., a first flexible contact) extends from an end 218 (e.g., a first end) of the arm 202, and a flexible contact 220 (e.g., a second flexible contact) extends from an end 222 (e.g., a second end) of the arm 204. The flexible contact 216 and the flexible contact 220 protrude into the slot 214 such that the flexible contact 216 and/or the flexible contact 220 engages an arm of another genderless electric terminal (e.g., an arm 302 of the genderless electric terminal 300 of FIG. 3) when that arm is inserted into the slot 214 of the genderless electric terminal 200 to electrically connect the genderless electric terminal 200 and the other genderless electric terminal. For example, the flexible contact 216 and the flexible contact 220 are bent inwardly into the slot 214 from the end 218 and the end 222, respectively, such that flexible contact 216 and the flexible contact 220 extend along at least a portion of the length 208 of the genderless electric terminal 200.

The flexible contact 216 of the illustrated example extends at least half the length 208 along the arm 202 to facilitate the flexible contact 216 in engaging the arm of the other genderless electric terminal when inserted into the slot 214. For example, the flexible contact 216 of the genderless electric terminal 200 and a corresponding flexible contact of the other genderless electric terminal each extend a length 224 that is at least half the length 208 of the genderless electric terminal 200 to facilitate the flexible contact 216 in contacting the arm of the other genderless electric terminal (e.g., at least 1 millimeter along the length 224) when the arm of the other genderless electric terminal is inserted into the slot 214. In the illustrated example, a portion of the length of the flexible contact 216 forms a flat surface 226 to facilitate the flexible contact 216 in engaging the arm of the other genderless electric terminal when inserted into the slot 214. Further, a portion 228 of the flexible contact 216 extends toward the arm 204 to facilitate the flexible contact 216 in engaging the arm of the other genderless electric terminal when inserted into the slot 214. For example, the portion 228 extends toward the arm 204 by at least a third of a height 230 of the slot 214 to facilitate the flexible contact 216 in engaging the arm of the other genderless electric terminal.

Likewise, the flexible contact 220 of the illustrated example extends at least half the length 208 along the arm 204 (e.g., extends the length 224 of the flexible contact 216) to facilitate the flexible contact 220 in engaging the arm of the other genderless electric terminal when inserted into the slot 214. Further, a portion of the length of the flexible contact 220 forms a flat surface 232 to facilitate the flexible contact 220 in engaging the arm of the other genderless electric terminal when inserted into the slot 214. Additionally or alternatively, a portion 234 of the flexible contact 220 extends toward the arm 202 to facilitate the flexible contact 220 in engaging the arm of the other genderless electric terminal when inserted into the slot 214. For example, the portion 234 extends toward the arm 202 by at least a third of the height 230 of the slot 214 to facilitate the flexible contact 220 in engaging the arm of the other genderless electric terminal.

Further, as illustrated in FIG. 2, the flexible contact 216 and the flexible contact 220 extend along a width 236 of the arm 202 and the arm 204, respectively. In other examples, the flexible contact 216 and/or the flexible contact 220 may extend along a portion of the width 236. Further, in other examples, the flexible contact 216 and/or the flexible contact 220 includes a plurality of adjacent finger-like extensions that each extend along a portion of the width 236 and are spaced apart from the other finger-like extensions along the width 236.

FIG. 3 depicts the genderless electric terminal 200 and the genderless electric terminal 300 coupled together. The genderless electric terminal 300 includes an arm 302, an arm 304 opposite the arm 302, a flexible terminal 306 protruding from the arm 302, a flexible terminal 308 protruding from the arm 304, and a slot 310. Further, the genderless electric terminal 300 of the illustrated example includes components that are identical or substantially similar to those of the genderless electric terminal 200. Because the components of the genderless electric terminal 200 have been disclosed in detail in FIG. 2, those components of the genderless electric terminal 300 will not be disclosed in further detail below In the illustrated example, the arm 302 is inserted into the slot 214 and the arm 204 is inserted into the slot 310 to connect the genderless electric terminal 200 and the genderless electric terminal 300. The symmetrical structures of the genderless electric terminal 200 and the genderless electric terminal 300 also enable the genderless electric terminal 200 and the genderless electric terminal 300 to be connected together by inserting the arm 304 into the slot 214 and the arm 202 is inserter into the slot 310. To retain the arm 302 of the genderless electric terminal 300 in the slot 214 of the genderless electric terminal 200, the arm 202 of the genderless electric terminal 200 is biased to apply a force (e.g., a first normal force) on the arm 302 toward the arm 204 of the genderless electric terminal 200 and the arm 204 is biased to apply a force (e.g., a second normal force) on the arm 302 toward the arm 302 to clamp the arm 302 in the slot 214. The arm 202 and the arm 204 are configured to be biased in their respective directions independently of a corresponding housing or connector (e.g., a plastic housing) to prevent the arm 202 and/or the arm 204 from potentially becoming unbiased if the corresponding housing becomes deformed. For example, the flexible contact 216 engages a surface 312 (e.g., a first surface) of the arm 302 and the flexible contact 220 engages an opposing surface 314 (e.g., a second surface) of the arm 302. Further, because the genderless electric terminal 200 and the genderless electric terminal 300 are configured to connect at any point(s) along the width 236, the genderless electric terminal 200 and the genderless electric terminal 300 are configured to provide a tolerance in the relative position of the genderless electric terminal 200 and the genderless electric terminal 300 in which an electrical connection is able to be formed between the genderless electric terminal 200 and the genderless electric terminal 300. That is, the genderless electric terminal 200 and the genderless electric terminal 300 are configured to deter axial movement of the genderless electric terminal 200 and/or the genderless electric terminal 300 from disconnecting the electrical connection between the genderless electric terminal 200 and the genderless electric terminal 300.

Figure 4:
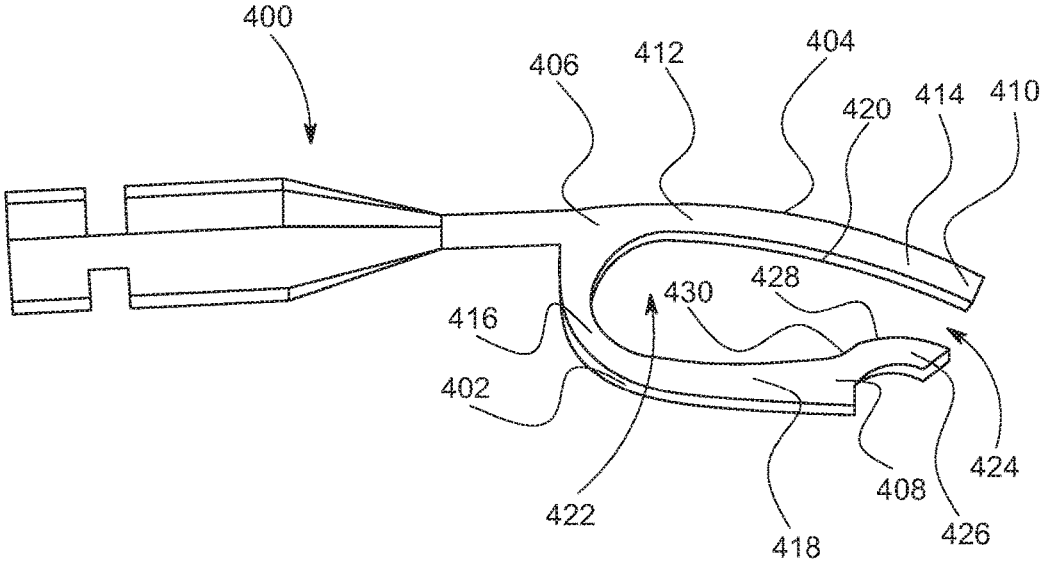
FIG. 4 illustrates another example genderless electric terminal.
Figure 5:
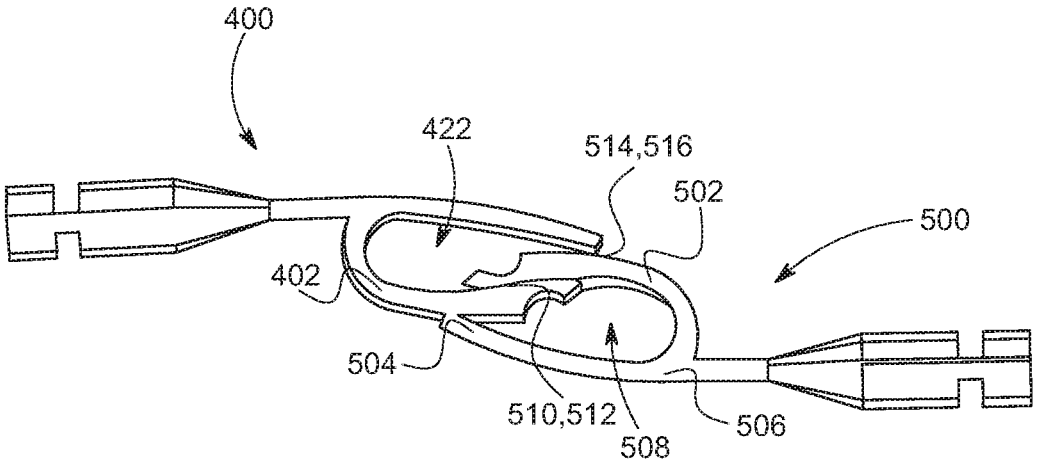
FIG. 5 illustrates the genderless electric terminal of FIG. 4 coupled to another genderless electric terminal.

FIGS. 4 and 5 illustrate an example genderless electric terminal 400 and another example genderless electric terminal 500. More specifically, FIG. 4 depicts the genderless electric terminal 400 (e.g., a first genderless terminal), and FIG. 5 depicts the genderless electric terminal 400 and the genderless electric terminal 500 (e.g., a second genderless terminal) coupled together. For example, the genderless electric terminal 400 is one of the genderless electric terminals 108 of the connector 104, and the genderless electric terminal 500 is one of the genderless electric terminals 110 of the connector 106.

As illustrated in FIG. 4, the genderless electric terminal 400 includes a convex arm 402 (e.g., a first convex arm), a convex arm 404 (e.g., a second convex arm) opposite the convex arm 404, and a base 406. As illustrated in FIG. 4, the genderless electric terminal 400 is integrally formed with the convex arm 402 integrally connected to the convex arm 404 via the base 406. Further, the base 406, the convex arm 402, and the convex arm 404 extend a width of the genderless electric terminal 400.

The convex arm 402 includes a distal end 408 (e.g., a first distal end) opposite to the base 406, and the convex arm 404 includes a distal end 410 opposite to the base 406. For example, the convex arm 402 includes a first section 412 adjacent to the base 406 that extends away from the convex arm 404 and a second section 414 adjacent to the distal end 408 that extends toward the convex arm 404 to define a convex-shaped cross-section of the convex arm 402. Similarly, the convex arm 404 includes a first section 416 adjacent to the base 406 that extends away from the convex arm 402 and a second section 418 adjacent to the distal end 410 that extends toward the convex arm 402 to define a convex-shaped cross-section of the convex arm 404.

The genderless electric terminal 400 also includes an inner surface 420 that is defined by the convex arm 402 and the convex arm 404. Further, the inner surface 420 defines a slot 422 located between the convex arm 402 and the convex arm 404. The inner surface 420 is to engage an arm of another genderless electric terminal (e.g., a convex arm 502 of the genderless electric terminal 500 of FIG. 5) when the arm is inserted into the slot 422 to form an electrical connection between the genderless electric terminal 400 and the genderless electric terminal 500. The distal end 408 and the distal end 410 define an opening 424 through which the arm of the other genderless electric terminal is inserted into the slot 422. For example, the slot 422 and the opening 424 of the slot 422 extend the width of the genderless electric terminal 400.

The convex arm 402 and the convex arm 404 retain the arm of the other genderless electric terminal in the slot 422 of the genderless electric terminal 400. For example, the distal end 408 of the convex arm 402 and the distal end 410 of the convex arm 404 clamp together on the arm of the other genderless contact receiver when that arm is inserted into the slot 422 of the genderless electric terminal 400 through the opening 424. In the illustrated example, the base 406, the convex arm 402, and the convex arm 404 form a horseshoe-shaped or c-shaped cross-section of the genderless electric terminal 400 in which the distal end 408 and the distal end 410 extend toward each other to retain the arm of the other genderless electric terminal in the slot 422.

In the illustrated example, a flange 426 (e.g., a first flange) protrudes from the distal end 408 of the convex arm 402 in an outward direction away from the slot 422 and/or the convex arm 404. In some examples, a flange (e.g., a second flange) also protrudes from the distal end 410 of the convex arm 404 in an outward direction away from the slot 422 and/or the convex arm 402. The flange 426 protruding from the convex arm 402 has a curved surface 428 that is to engage the other genderless electric terminal when the convex arm 402 is inserted into a slot of the other genderless electric terminal (e.g., a slot 508 of the genderless electric terminal 500 of FIG. 5) to electrically connect the genderless electric terminal 400 to the other genderless electric terminal. Further, a portion of the inner surface 420 defined by the convex arm 402 forms a flat surface 430 (e.g., a first flat surface) to facilitate the convex arm 402 in engaging the arm of the other genderless electric terminal when that arm is inserted into the slot 422 through the opening 424. For example, the second section 414 of the convex arm 402 defines the flat surface 430.

FIG. 5 depicts the genderless electric terminal 400 and the genderless electric terminal 500 coupled together. The genderless electric terminal 500 includes a convex arm 502, a convex arm 504 opposite the convex arm 502, a base 506, and a slot 508. Further, the genderless electric terminal 500 of the illustrated example includes components that are identical or substantially similar to those of the genderless electric terminal 400. Because the components of the genderless electric terminal 400 have been disclosed in detail in FIG. 4, those components of the genderless electric terminal 500 will not be disclosed in further detail below In the illustrated example, the convex arm 502 is inserted into the slot 422 and the convex arm 402 is inserted into the slot 508 to connect the genderless electric terminal 400 and the genderless electric terminal 500. To retain the convex arm 502 in the slot 422, the convex arm 402 is biased to apply a force (e.g., a first normal force) toward the convex arm 404 on the convex arm 502, and the convex arm 404 is biased to apply a force (e.g., a second normal force) toward the convex arm 402 on the convex arm 502. The convex arm 402 and the convex arm 404 are configured to be biased in their respective directions independently of a corresponding housing or connector (e.g., a plastic housing) to prevent the convex arm 402 and/or the convex arm 404 from potentially becoming unbiased if the corresponding housing becomes deformed. Further, a portion 510 of the inner surface 420 defined by the convex arm 402 (e.g., the curved surface 428) engages a first surface 512 of the convex arm 502 and a portion 514 of the inner surface 420 defined by the convex arm 404 engages a second surface 516 of the convex arm 502 opposite the first surface 512 to clamp the convex arm 502 in the slot 422 to connect the genderless electric terminal 500 to the genderless electric terminal 400.

Figure 6:
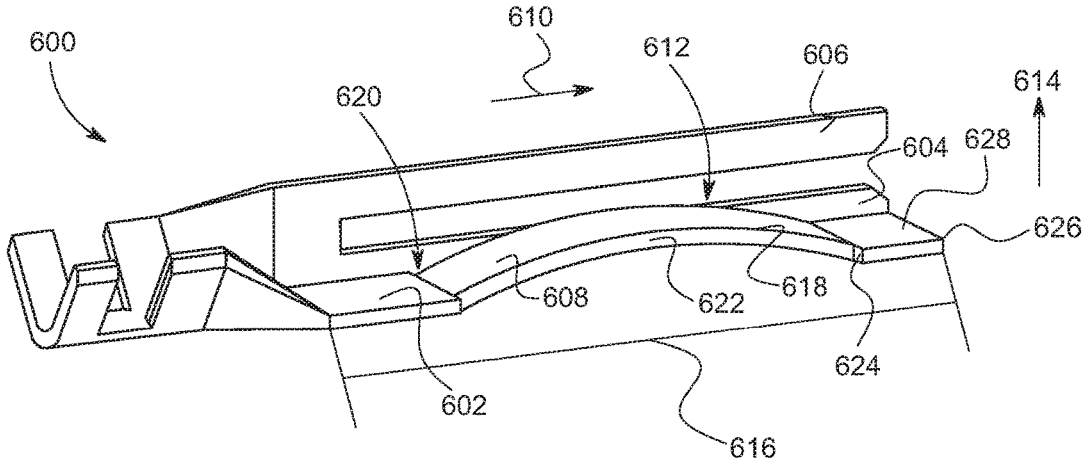
FIG. 6 illustrates another example genderless electric terminal.
Figure 7:
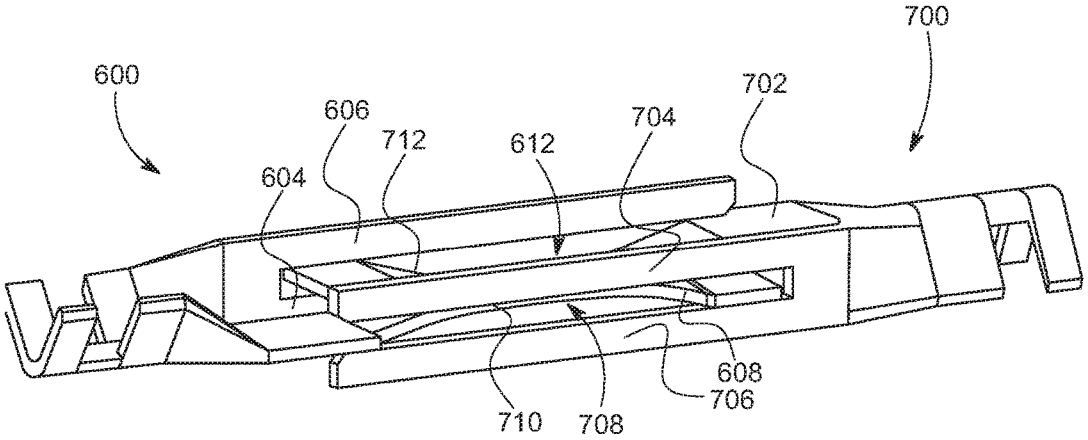
FIG. 7 illustrates the genderless electric terminal of FIG. 6 coupled to another genderless electric terminal.

FIGS. 6 and 7 illustrate an example genderless electric terminal 200 and another example genderless electric terminal 300. More specifically, FIG. 6 depicts the genderless electric terminal 600 (e.g., a first genderless terminal), and FIG. 7 depicts the genderless electric terminal 600 and the genderless electric terminal 700 (e.g., a second genderless terminal) coupled together. For example, the genderless electric terminal 600 is one of the genderless electric terminals 108 of the connector 104, and the genderless electric terminal 700 is one of the genderless electric terminals 110 of the connector 106.

As illustrated in FIG. 6, the genderless electric terminal 600 includes a base 602, an arm 604 (e.g., a first arm), an arm 606 (e.g., a second arm) opposite the arm 604, and an arched arm 608. In the illustrated example, the genderless electric terminal 600 is integrally formed such that the base 602, the arm 604, the arm 606, and the arched arm 608 are integrally connected. The arched arm 608 extends in a direction 610 (e.g., a first direction) from the base 602. Further, the arm 604 and the arm 606 are adjacent to the arched arm 608. The arm 604 and the arm 606 extend from the base 602 in the direction 610 and are spaced apart from each other to define a slot 612 that extends in the direction 610 adjacent to the arched arm 608. For example, the arm 604 and the arm 606 are spaced apart from each other in a direction 614 (e.g., a second direction) that is perpendicular to the direction 610. In the illustrated example, the arched arm 608, the arm 604, and the arm 606 extend along a length 616 of the genderless electric terminal 600. The arched arm 608 is configured to be inserted into a slot of another genderless electric terminal (e.g., a slot 708 of the genderless electric terminal 700 of FIG. 7) and the slot 612 defined by the arm 604 and the arm 606 is configured to receive an arched arm of the other genderless electric terminal (e.g., an arched arm 712 of the genderless electric terminal 700 of FIG. 7) to connect the genderless electric terminal 600 to the other genderless electric terminal. In some examples, the arched arm 608 is received by the slot of the other genderless electric terminal and the slot 612 receives the arched arm of the other genderless electric terminal simultaneously to connect the genderless electric terminal 600 and the other genderless electric terminal together.

In the illustrated example, the arched arm 608 includes an arched portion 618 that extends in the direction 614. In other examples, the arched portion 618 extends in another direction (e.g., a direction opposite to the direction 614). The arched arm 608 is arched and flexible to facilitate being inserted into the slot of the other genderless electric terminal. Further, the arched arm 608 is arched and flexible to facilitate engagement to a surface of the other genderless electric terminal (e.g., a surface 710 of the genderless electric terminal 700 of FIG. 7) when the arched arm 608 is inserted into the slot of the other genderless electric terminal. For example, while the arched arm 608 is adjacent to the arm 604, the arched arm 608 is the spaced apart from the arm 604 by a slot 620 (e.g., a second slot) to enable the arched arm 608 to flex separately from the arm 604 and/or the arm 606. For example, the slot 620 between the arched arm 608 and the arm 604 extends in a direction (e.g., a third direction) perpendicular to the direction 610 and the direction 614.

A surface 622 (e.g., a first surface) of the arched arm 608 engages the surface defining the slot of the genderless electric terminal to electrically connect the genderless electric terminal 600 and the other genderless electric terminal. For example, the arched arm 608 includes a distal end 624 opposite the base 602. A flange 626 protrudes from the distal end 624 to further facilitate contact and/or engagement between the surface 622 of the arched arm 608 and the surface of the other genderless electric terminal when the arched arm 608 is inserted into the slot of the other genderless electric terminal. In some examples, the flange includes a flat surface 628 that further facilitates contact and/or engagement between the surface 622 of the arched arm 608 and the surface of the other genderless electric terminal. Additionally or alternatively, a surface 632 (e.g., a second surface) of the arm 604 and the arm 606 that defines the slot 612 engages a surface of the arched arm of the other genderless electric terminal (e.g., a surface of the genderless electric terminal 700 of FIG. 7) when the slot 612 receives the arched arm to electrically connect the genderless electric terminal 600 and the other genderless electric terminal.

FIG. 7 depicts the genderless electric terminal 600 and the genderless electric terminal 700 coupled together. The genderless electric terminal 700 includes a base 702, an arm 704, an arm 706 opposite the arm 704, a slot 708 defined by the arm 704 and the arm 706, a surface 710 defining the slot 708, an arched arm 712, and a surface of the arched arm 712. Further, the genderless electric terminal 700 of the illustrated example includes components that are identical or substantially similar to those of the genderless electric terminal 600. Because the components of the genderless electric terminal 600 have been disclosed in detail in FIG. 6, those components of the genderless electric terminal 700 will not be disclosed in further detail below In the illustrated example, the arched arm 608 of the genderless electric terminal 600 is inserted into the slot 708 of the genderless electric terminal 700 and the arched arm 712 of the genderless electric terminal 700 is inserted into the slot 612 of the genderless electric terminal 600 to connect the genderless electric terminal 600 and the genderless electric terminal 700. For example, to electrically connect the genderless electric terminal 600 and the genderless electric terminal 700, the arched arm 608 engages the arm 704 and/or the arm 706, and the arm 604 and/or the arm 606 engages the arched arm 712. To retain the arched arm 712 in the slot 612, the arm 604 is biased to apply a force (e.g., a first normal force) on the arched arm 712 toward the arm 606 and the arm 606 is biased to apply a force (e.g., a second normal force) on the arched arm 712 toward the arm 604. The arm 604 and the arm 606 are configured to be biased in their respective directions independently of a corresponding housing or connector (e.g., a plastic housing) to prevent the arm 604 and/or the arm 606 from potentially becoming unbiased if the corresponding housing becomes deformed. Similarly, to retain the arched arm 608 in the slot 708, the arm 704 applies a force (e.g., a first normal force) on the arched arm 608 toward the arm 706 and the arm 706 applies a force (e.g., a second normal force) on the arched arm 608 toward the arm 704.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A genderless terminal comprising:

a first arm;

a second arm opposite the first arm;

a wall integrally connecting the first arm and the second arm to define a slot, wherein the first arm, the second arm, and the wall extends a length of the genderless terminal; and a first flexible contact extending from a first end of the first arm and protruding into the slot to engage a first arm of a different genderless terminal.

2. The genderless electric terminal of claim 1, further including a second flexible contact extending from a second end of the second arm and protruding into the slot, at least one of the first flexible contact and the second flexible contact engages the first arm of the different genderless electric terminal when the first arm of the different genderless electric terminal is inserted into the slot.

3. The genderless electric terminal of claim 2, wherein, to retain the first arm of the different genderless electric terminal in the slot, the first arm applies a first force on the different genderless electric terminal toward the second arm and the second arm applies a second force on the different genderless electric terminal toward the first arm.

4. The genderless electric terminal of claim 2, wherein the first flexible contact engages a first surface of the first arm of the different genderless electric terminal and the second flexible contact engages an opposing second surface of the first arm of the different genderless electric terminal.

5. The genderless electric terminal of claim 2, wherein the first arm or the second arm is inserted into a different slot of the different genderless electric terminal when the first arm of the different genderless electric terminal is inserted into the slot.

6. The genderless electric terminal of claim 1, wherein the wall is integrally connected to a first edge of the first arm and a second edge of the second arm.

7. The genderless electric terminal of claim 1, wherein the first arm is parallel to the second arm and the wall is perpendicular to the first arm and the second arm.

8. The genderless electric terminal of claim 1, wherein the first flexible contact extends at least half the length along the first arm to facilitate the first flexible contact in engaging the first arm of the different genderless electric terminal when the first arm of the different genderless electric terminal is inserted into the slot.

9. The genderless electric terminal of claim 1, wherein the first flexible contact extends along a width of the first arm.

10. The genderless electric terminal of claim 1, wherein a portion of a length of the first flexible contact forms a flat surface to facilitate the first flexible contact in engaging the first arm of the different genderless electric terminal when the first arm of the different genderless electric terminal is inserted into the slot.

11. The genderless electric terminal of claim 1, wherein the first flexible contact is bent inwardly into the slot from the first end of the first arm such that the first flexible contact extends along at least a portion of a length of the first arm.

12. The genderless electric terminal of claim 1, wherein a portion of the first flexible contact extends toward the second arm to facilitate the first flexible contact in engaging the first arm of the different genderless electric terminal when the first arm of the different genderless electric terminal is inserted into the slot.

13. The genderless electric terminal of claim 12, wherein the portion of the first flexible contact extends toward the second arm at least a third of a height of the slot.

14. A vehicle comprising:

an electronic control unit;

a first connector electrically connected to the electronic control unit; and a second connector to connect to the first connector, wherein the first connector and the second connector include genderless electric terminals that each include:

opposing arms;

a wall integrally connecting the opposing arms to define a slot, the wall and the opposing arms extending a length of the genderless electric terminal; and flexible contacts extending from ends of the opposing arms and protruding into the slot.

15. The vehicle of claim 14, wherein, to electrically connect the second connector to the electronic control unit, the genderless electric terminals of the first connector engage the genderless electric terminals of the second connector to connect the second connector and the first connector.

16. The vehicle of claim 15, wherein the genderless electric terminals of the first connector include a first genderless electric terminal and the genderless electric terminals of the second connector include a second genderless electric terminal.

17. The vehicle of claim 16, wherein to connect the first genderless electric terminal and the second genderless electric terminal, one of the opposing arms of the first genderless electric terminal is inserted into the slot of the second genderless electric terminal and one of the opposing arms of the second genderless electric terminal simultaneously is inserted into the slot of the first genderless electric terminal.

18. The vehicle of claim 16, wherein the flexible contacts extends at least half a length of the corresponding genderless electric terminal to facilitate the flexible contacts of the first genderless electric terminal to engage the flexible contacts of the second genderless electric terminal.

19. The vehicle of claim 14, wherein the flexible contacts of each of the genderless electric terminals include a first flexible contact extending from a first end of one of the opposing arms and a second flexible contact extending from a second end of the other of the opposing arms.

* * * * *